US012780361B2

(12) United States Patent
Furrer et al.

(10) Patent No.: US 12,780,361 B2
(45) Date of Patent: Nov. 3, 2026

(54) FOLDING MARINE CLEAT WITH FASTENER RETENTION

(71) Applicant: Patrick Industries, Inc., Elkhart, IN (US)

(72) Inventors: Paul Masato Furrer, Everett, WA (US); Paul Olliges, Everett, WA (US)

(73) Assignee: Patrick Industries, Inc., Elkhart, IN (US)

( * ) Notice: Subject to any disclaimer, the term of this patent is extended or adjusted under 35 U.S.C. 154(b) by 209 days.

(21) Appl. No.: 18/900,171

(22) Filed: Sep. 27, 2024

(65) Prior Publication Data

US 2026/0091851 A1 Apr. 2, 2026

(51) Int. Cl.
*B63B 21/04* (2006.01)

(52) U.S. Cl.
CPC ..... *B63B 21/045* (2013.01)

(58) Field of Classification Search
CPC ..... B63B 21/045; F16M 2200/063; F16M 11/046; F16M 11/2021; B60N 2/507
USPC ..... 248/74.5, 595, 584–585, 564, 421
See application file for complete search history.

(56) References Cited

U.S. PATENT DOCUMENTS 226,053 A * 3/1880 Finnegan ..... A47B 21/0314 108/138
263,910 A * 9/1882 Hutton ..... A47B 3/00 297/235
385,831 A * 7/1888 Adelsperger ..... A47B 3/00 297/235
4,270,478 A * 6/1981 Kafka ..... B63B 21/045 114/218
5,438,944 A * 8/1995 Burke ..... B63B 21/045 114/218
7,131,387 B1 * 11/2006 Czipri ..... B63B 21/045 114/218
10,495,252 B2 * 12/2019 Lee ..... F16M 11/046
2018/0356023 A1 * 12/2018 Yen ..... F16M 11/10
2022/0388608 A1 * 12/2022 Jean ..... B63B 21/045
2025/0065987 A1 * 2/2025 Hawkes ..... B63B 21/045

* cited by examiner

*Primary Examiner* — Christopher Garft
(74) *Attorney, Agent, or Firm* — Christensen O'Connor Johnson Kindness PLLC

(57) ABSTRACT

A folding marine cleat can include a base and a cleat head having a detent spring member. The cleat head can be positionable with respect to the base in stowed and deployed positions by a four-bar linkage with first and second legs to transition the cleat head between deployed and stowed positions. The legs can include stowed and deployed flat portions positionable to selectively be in contact with and abutting the detent spring member to retain the cleat head in the stowed or deployed position. The base can include fastener retention slots with opposing opening surfaces and opposing retention surfaces being spaced apart at a distance to receive a square portion of a fastener therebetween to fix the fastener in axial rotation with respect to the cleat base, with the opposing opening surfaces being spaced apart at a distance narrower than a distance across the square portion of the fastener.

20 Claims, 9 Drawing Sheets

FOLDING MARINE CLEAT WITH FASTENER RETENTION

BACKGROUND

A marine cleat is an accessory typically used on watercraft to provide a point to tie-down mooring, rigging, anchor, fender, and other lines to the watercraft. For example, when mooring the watercraft, a line is tied from a structure, such as a dock, other boat, pilon, etc., to the marine cleat on the watercraft to secure the watercraft to the structure. Cleats can also be used for leverage during watercraft maneuvers, such as with spring lines, or when a user partially wraps the line around the cleat to pull the line in or pay the line out in a controlled manner.

A cleat typically includes two projections parallel to the mounting surface and arranged such that a cleat hitch (a knot that secures the line portion but can be readily undone) can be tied around the projections, or such that the line can be wrapped around either of the projections during use of the cleat as leverage. The portion of the cleat with the projections (e.g., the cleat head) can be fixed or foldable. A fixed cleat does not include any moving parts, while a foldable cleat (or "folding cleat") allows the projections to be stowed when not in use for a flush and sleek folded position. Fixed cleats can be preferrable in high strength applications, or in situations where the projections of the cleat need to be accessible at all times. In other applications, folding cleats can be preferable, such as with cleats mounted near walkways, cleats on smaller watercraft, and/or cleats on modern watercraft, where a sleeker look is preferred.

The marine cleat can be mounted to the deck, hull, or other structure of the watercraft where lines are tied down. Typically, the marine cleat includes holes for fasteners to pass through and be secured to the mounting surface. For example, the cleat can have two to four holes where bolts pass through and into complementary holes in the watercraft. These bolts are typically secured with nuts or other fastening features on the other end (e.g., under the hull surface, under the deck surface, etc.). This type of arrangement makes the fastener heads visible from the upper surface of the cleat. In folding cleats, these fastener heads are either visible with the cleat in a closed, stowed position, or the heads are positioned under the folding portion of the cleat such that they are only visible when the cleat is in the open, deployed position. In most of these configurations, the head of the fastener must be held stationary (with a tool) while the nut or other fastening feature is tightened. This installation limitation can make some installations more labor intensive (e.g., by requiring multiple installation personnel). Embodiments of a marine cleat in accordance with aspects of the present disclosure provide improved installation, aesthetic, and performance as compared to known marine cleats.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1:
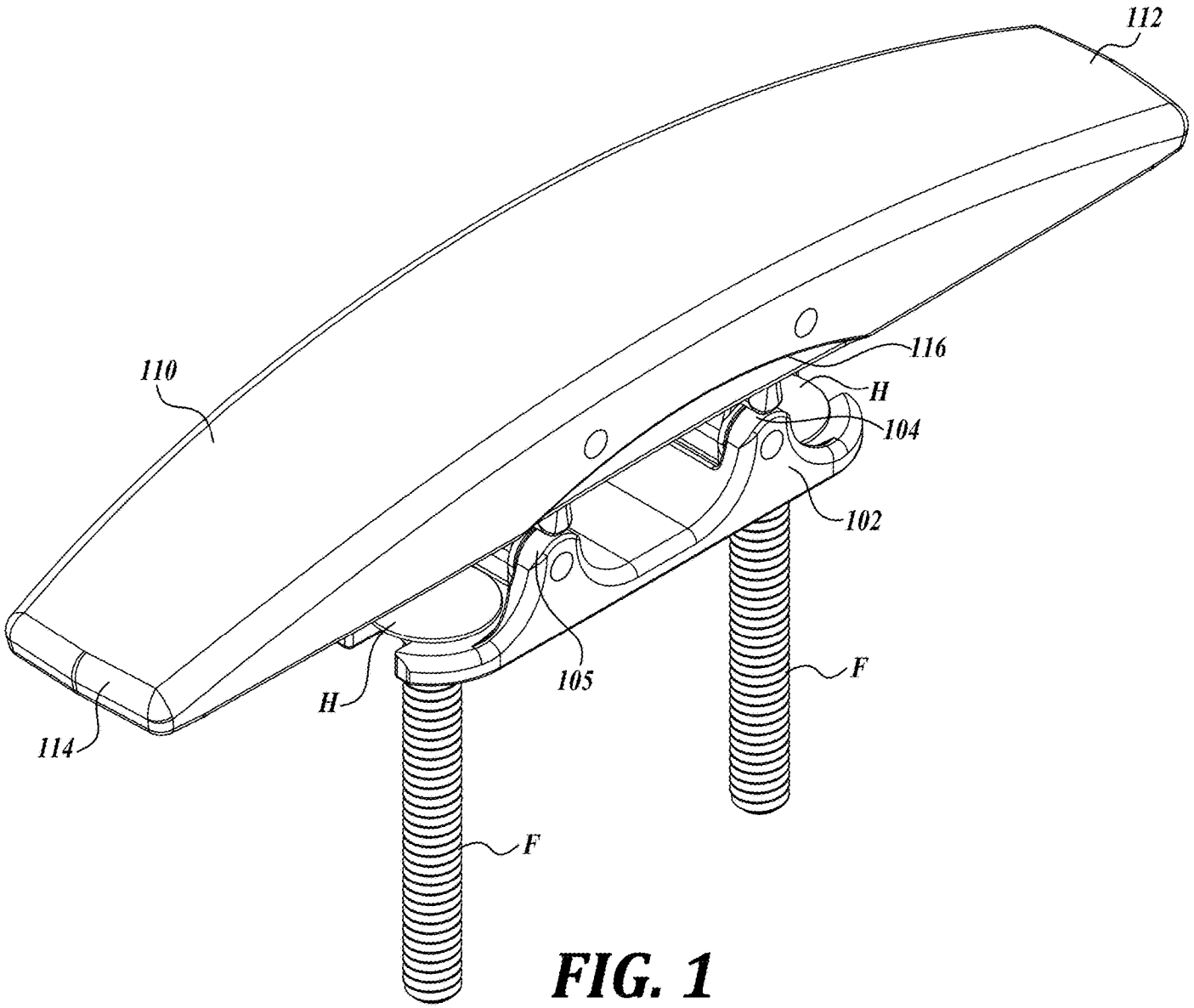
FIG. 1 is a top perspective view of one example of a folding marine cleat shown in a deployed position, in which technologies and/or methodologies of the present disclosure may be employed.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

As will be described in more detail below, the present disclosure provides examples of a folding marine cleat having a detent spring member configured to retain the folding marine cleat in the stowed and the deployed positions. The folding marine cleat further includes fastener retention features that are expected to aid in installation of the marine cleat to the watercraft and to improve the aesthetic appearance of the cleat by concealing the fasteners once installed and the cleat head stowed. Although a longitudinally folding marine cleat is shown, the present disclosure is suitable for use with other types of folding marine cleats, including laterally folding marine cleats. Further, although the cleats shown herein are generally described related to use in marine environments, e.g., watercraft, ships, yachts, docks, mooring structures, and the like, the cleats of the present disclosure are also suitable for use in non-marine environments.

The detent spring member is biased downward away from the cleat head and configured to flex upward during transition of the marine cleat between the deployed and stowed positions. The flat portions of the first and second legs, which will be described in greater detail below, allow the detent spring member to retain the marine cleat in either the stowed or deployed positions based on the flat interface between the detent spring member and the flat portions of the first and second legs. In a further aspect, the fasteners of the marine cleat can be retained during installation using fastener retention slots on the bottom of a cleat mounting base. These fastener retention slots can be arranged in opposing directions such that when the marine cleat is placed on the installation structure (e.g., a surface with corresponding mounting holes) the cleat can not be moved laterally or longitudinally along the surface. The fastener retention slots can be configured with features that correspond to a square portion under a head of a carriage bolt. In this regard, the fastener retention slots can receive the square portion from a direction above the fastener retention slot, and abut the four sides of the square portion. In the seated position, the fastener is secured against rotation such that a nut can be installed and torqued from the underside of the mounting surface without needing to hold the fastener head with a tool. In this regard, the marine cleat of the present disclosure can be typically installed by a single installation personnel, even in situations where both sides of the surface are not simultaneously accessible. Although a standard carriage bolt with a square portion is shown and described herein, in other embodiments, the fastener retention slots can be adapted to retain other types of fasteners.

Although embodiments of the present disclosure may be described with reference to marine cleats for watercraft, one skilled in the relevant art will appreciate that the disclosed embodiments are illustrative in nature and therefore should not be construed as limited to such an application. It should therefore be apparent that the disclosed technologies and methodologies have wide application, and therefore may be suitable for use with many types of cleat architectures, including floating platforms, docks, barges, personal watercraft, and the like, or suitable for use with non-marine applications. Accordingly, the following descriptions and illustrations herein should not limit the scope of the claimed subject matter.

FIG. 1 is a top perspective view of one example of a folding marine cleat 100 ("cleat 100"), with a cleat mounting base 102 ("base 102") and a cleat head 110 that is longitudinally foldable with respect to the base 102 (as will be described with reference to FIGS. 2A and 2B, below), in which technologies and/or methodologies of the present disclosure may be employed. The base 102 can be configured to receive a carriage-type bolt, shown as a fastener F, having a head H and a square portion S under the head H (see FIG. 2A). The base 102 can further include a first upward peak 104 and a second upward peak 105, each configured to receive a rotatable leg that will be described below. The cleat head 110 includes a first projection 112, a second projection 114 extending away from the first projection 112, and an opening relief 116. The cleat head 110 can be elongated, as shown, and the first and second projections 112 and 114 can extend longitudinally in opposite directions and substantially parallel to a mounting surface. The cleat head 110 and the first and second projections 112 and 114 can be configured to receive portions of a cleat hitch knot of a line (not shown) to tie down the watercraft to a structure, e.g., while mooring, or can be used for leverage by wrapping a line around one or both of the first and second projections 112 and 114.

The opening relief 116 is intended to provide an indented surface that can assist the user in gripping the cleat head 110 with a finger, thumb, or other object to deploy the cleat head 110 from the stowed position. A second opening relief 116 can be positioned on the opposite side of the cleat head 110 (e.g., laterally across, see FIG. 5) such that the user can grasp the cleat head 110 from both sides and engage both of the opening reliefs 116. In other embodiments, the opening relief 116 can be omitted, can be any suitable shape, size, position, and/or quantity, or may project away from the cleat head 110 to permit the user to grasp the cleat head 110 to overcome the detent and transition from the stowed position to the deployed position. In further embodiments, a friction feature may be applied to these sides of the cleat head 110 to assist the user in gripping the cleat head 110, such as a textured surface, coating, or etching, Although one example of a folding configuration of the cleat head 110 is shown, other configurations arranged to receive a knot or otherwise secure the line are also within the scope of the present disclosure, such as pop-up cleat heads, curved cleat heads, friction cleat heads, etc.

Figure 2A:
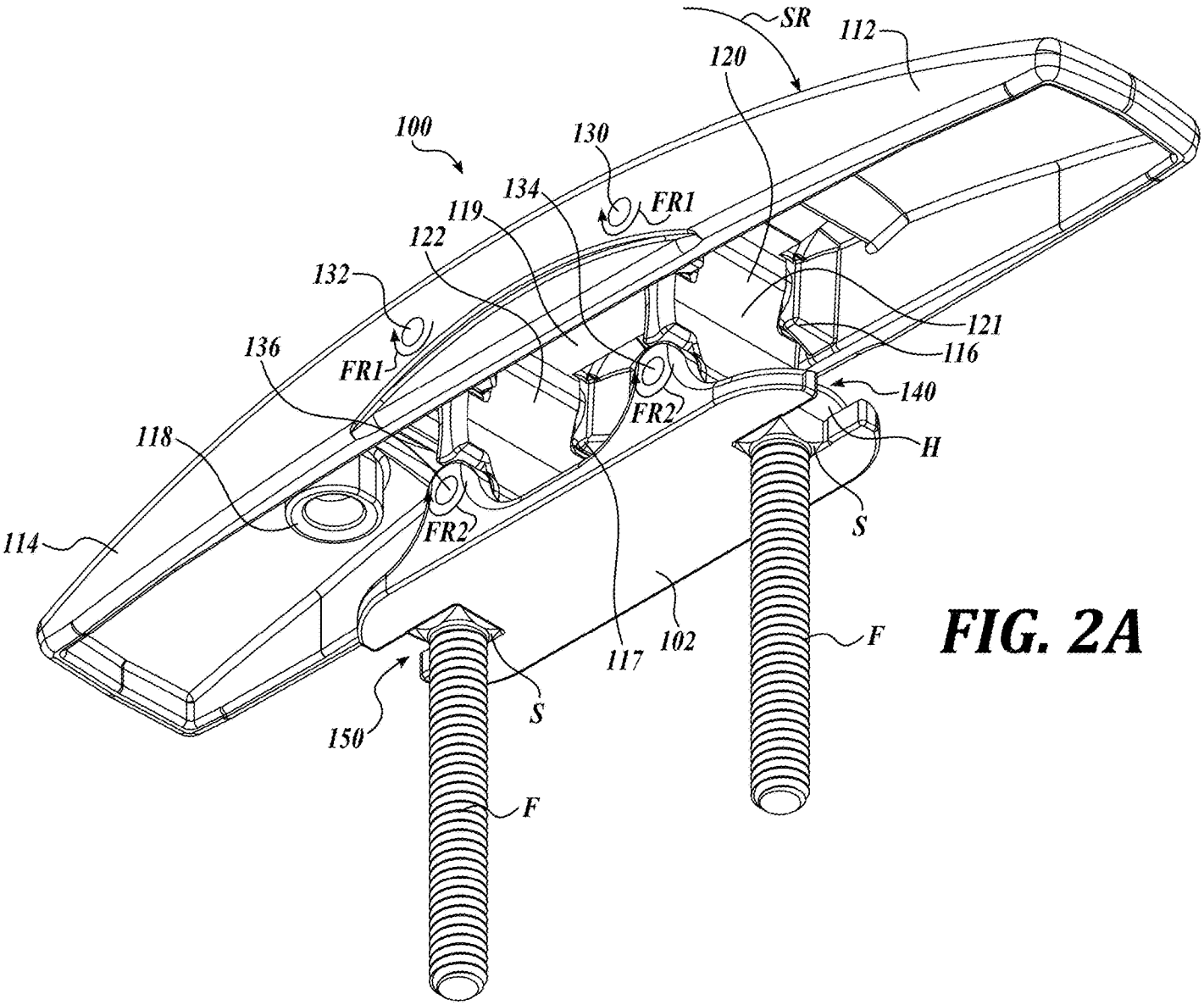
FIG. 2A is a bottom perspective view of the folding marine cleat of FIG. 1, with the folding marine cleat shown in a deployed position.
Figure 2B:
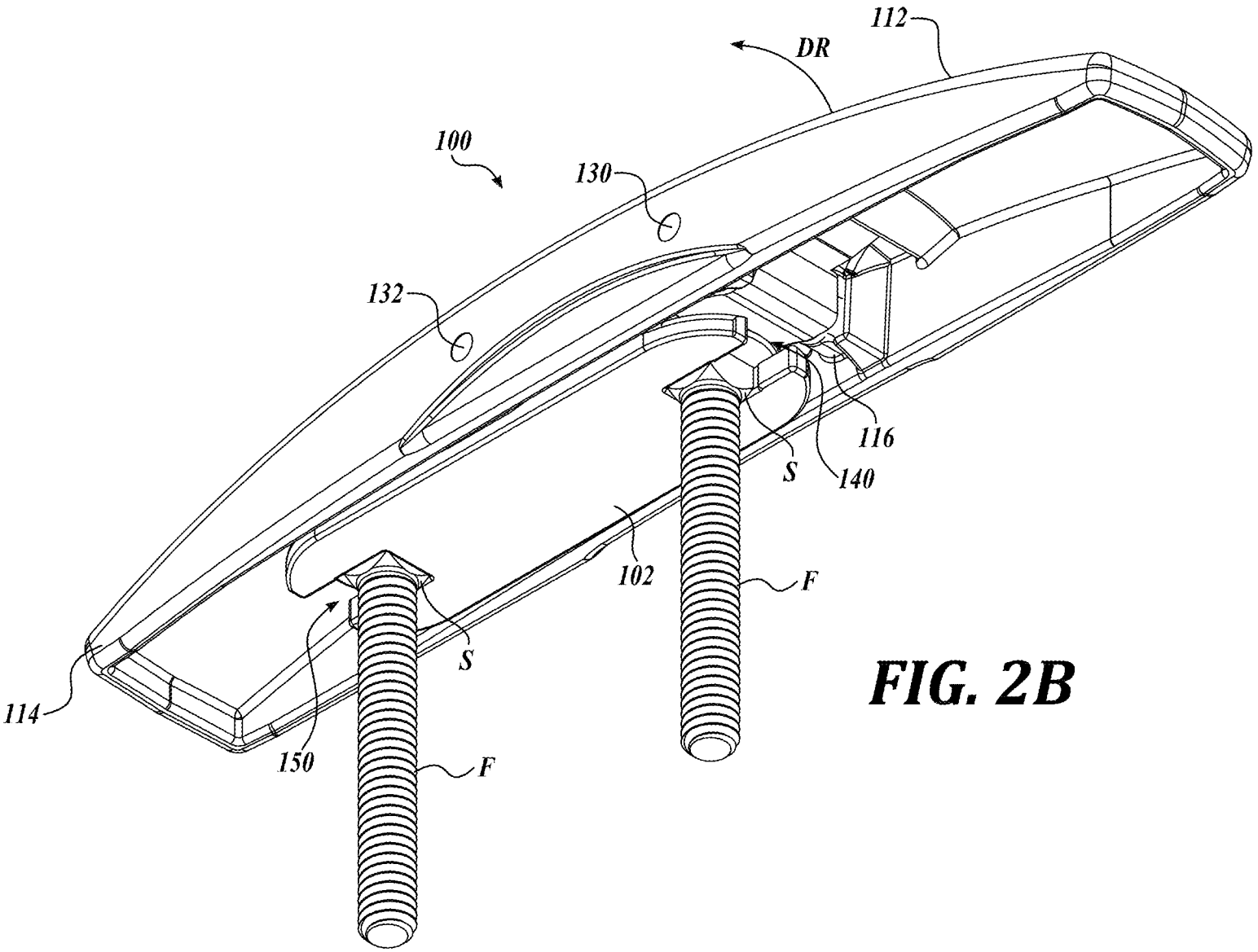
FIG. 2B is a bottom perspective view of the folding marine cleat of FIG. 1, with the folding marine cleat shown in a stowed position.
Figure 3A:
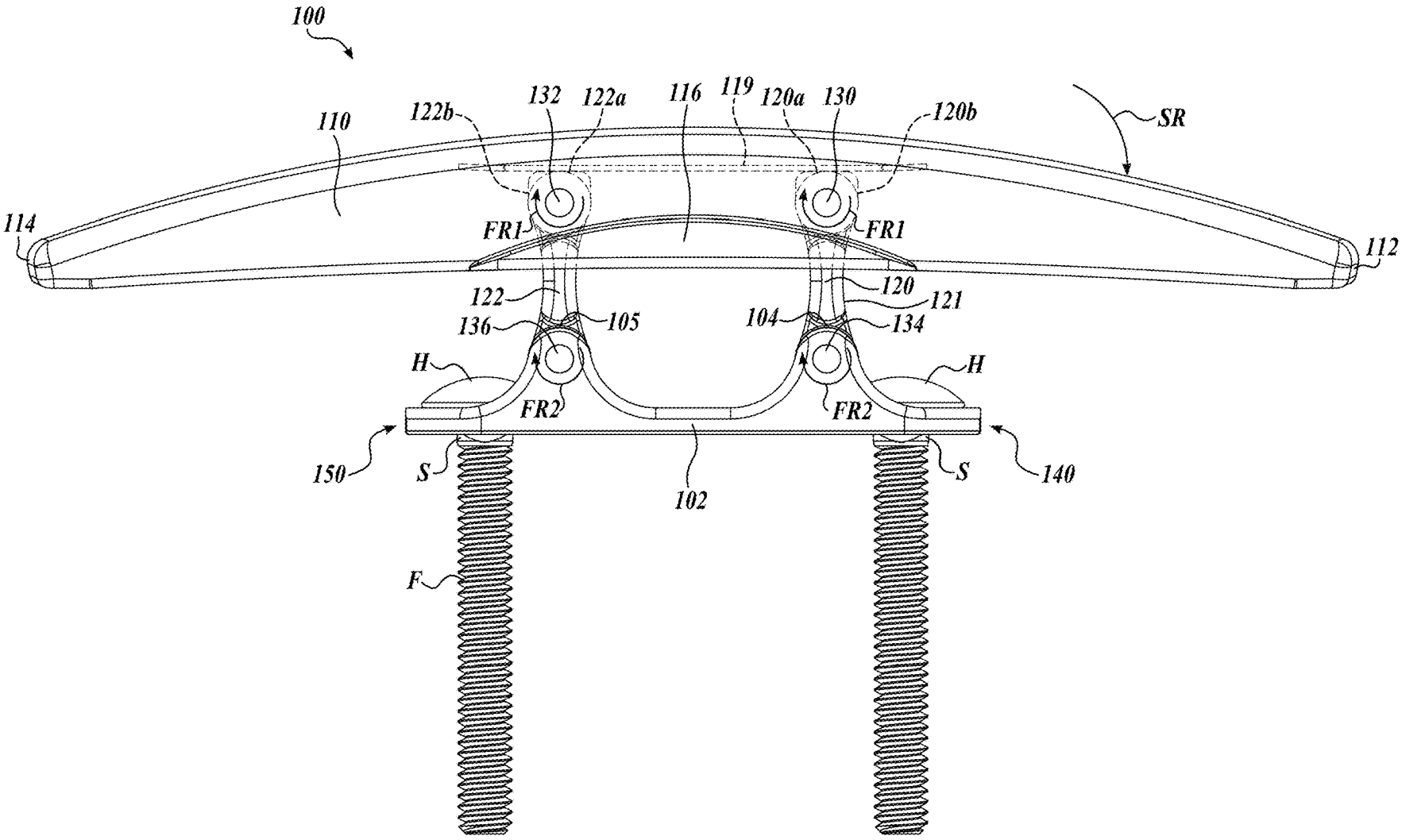
FIG. 3A is a side view of the folding marine cleat of FIG. 1, with the folding marine cleat shown in a deployed position.
Figure 3B:
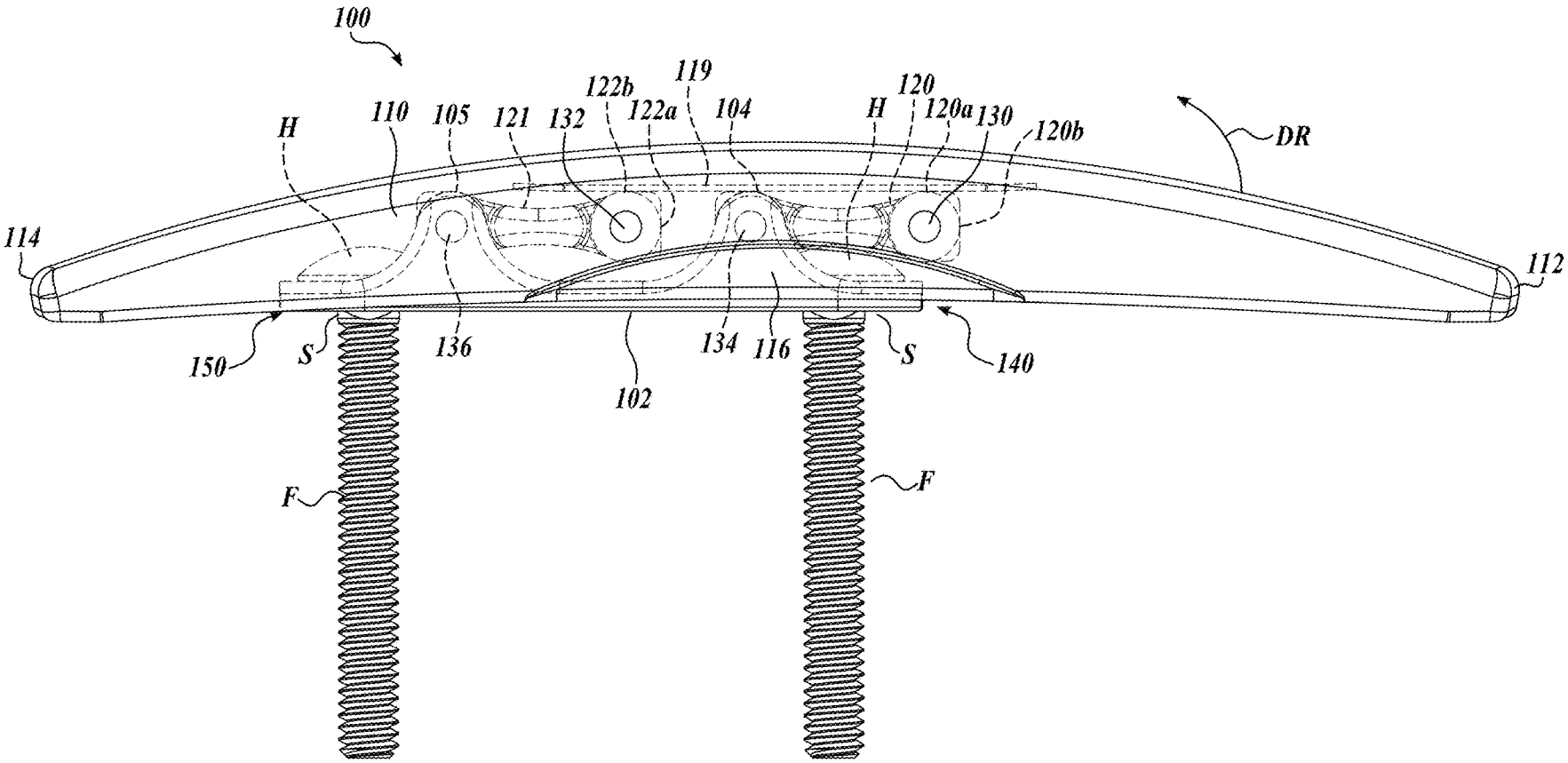
FIG. 3B is a side view of the folding marine cleat of FIG. 1, with the folding marine cleat shown in a stowed position.
Figure 4:
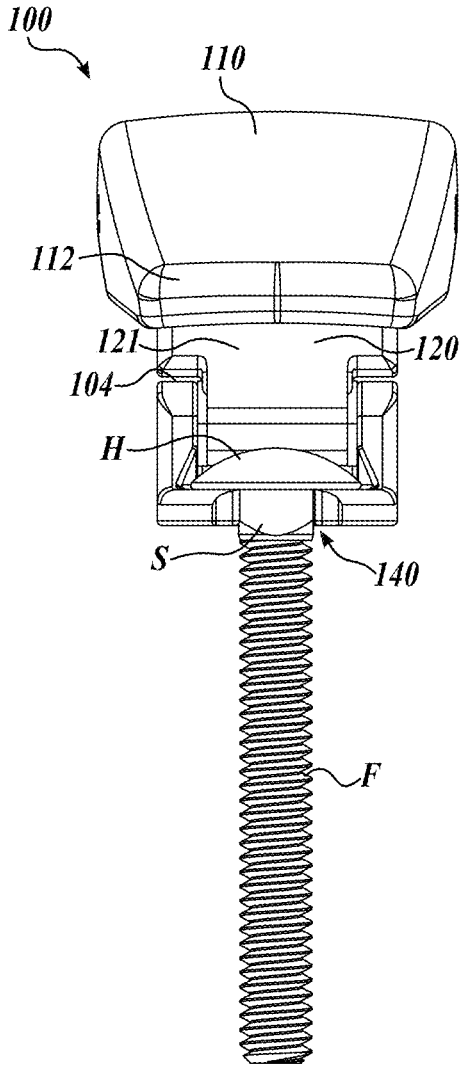
FIG. 4 is a side view of the folding marine cleat of FIG. 1, with the folding marine cleat shown in a stowed position.
Figure 5:
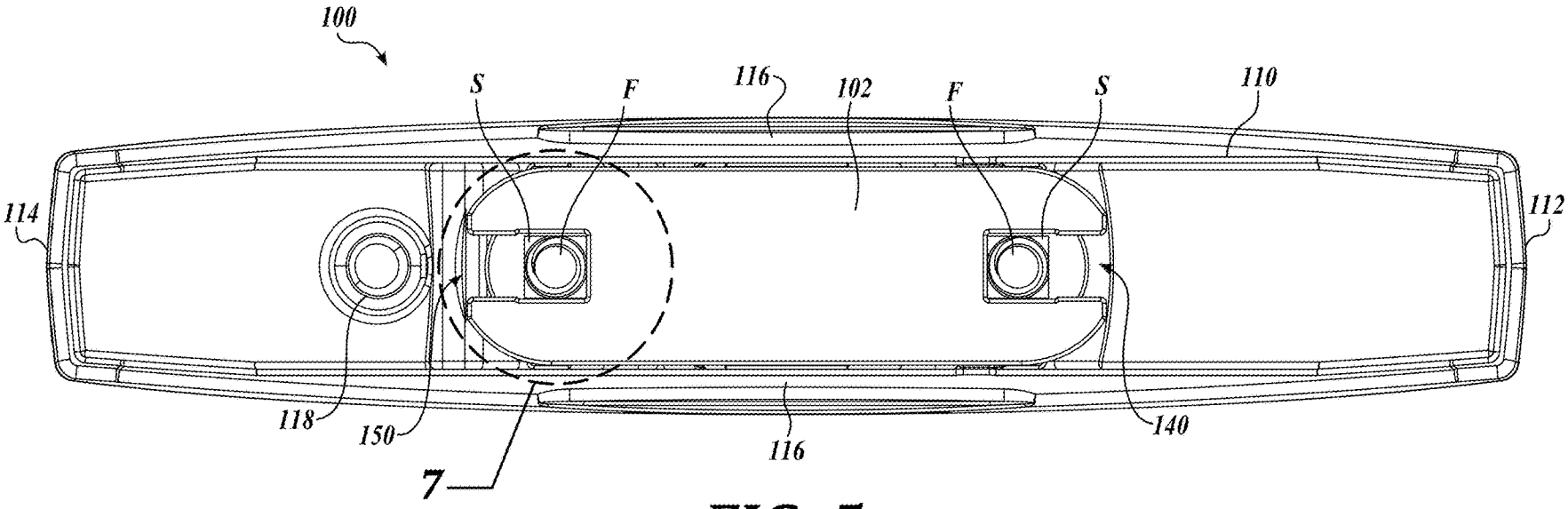
FIG. 5 is a bottom view of the folding marine cleat of FIG. 1, with the folding marine cleat shown in a stowed position.

FIGS. 2A and 2B are bottom perspective views of the cleat 100, FIGS. 3A and 3B are side views of the cleat 100, FIG. 4 is a side view of the cleat 100, and FIG. 5 is a bottom view of the cleat 100, with the cleat 100 shown in the deployed position (FIGS. 2A, 3A, 4, and 5) and the stowed position (FIGS. 2B and 3B). As shown in FIGS. 2A and 3A, the base 102 and the cleat head 110 can be hingedly coupled to a first leg 120 and a second leg 122, respectively, with the other end of the first and second legs 120 and 122 being hingedly coupled to the first and second upward peaks 104 and 105 (see FIG. 3A), respectively, of the base 102. The first and second legs 120 and 122 have lengths that permit the first and second projections 112 and 114 to be positioned away from the base 102 such that the line can be wrapped under the first and second projections 112 and 114 with portions of the cleat hitch knot.

In some embodiments, the first and second legs 120 and 122 are pivotable with respect to both the base 102 and the cleat head 110. In this regard, the first leg 120 has a first pivot end that is pivotable about a first pin 130 extending through the cleat head 110, and a second pivot end that is pivotable about a second pin 134 associated with the first upward peak 104 of the base 102. The second leg 122 has a first pivot end that is pivotable about a first pin 132 extending through the cleat head 110, and a second pivot end that is pivotable about a second pin 136 associated with the second upward peak 105 of the base 102. The first pins 130 and 132 and the second pins 134 and 136 are configured to permit the cleat head 110 to rotate longitudinally and transition between the stowed and deployed positions.

In some embodiments, the base 102, cleat head 110, first leg 120, and second leg 122 form a four-bar linkage, with the base 102 stationary (mounted to the mounting surface) and the cleat head 110 remaining substantially parallel to the base 102 during rotation in a stowing rotation direction SR, and the first and second legs 120 and 122 rotating about the second pins 134 and 136, respectively, in the direction of the stowing rotation direction SR. In some embodiments, the pins 130, 132, 134, and 136 extend entirely through the cleat head 110, the base 102, and the first and second legs 120 and 122. In other embodiments, such as the illustrated embodiments, the pins 130, 132, 134, and 136 only extend through one side of the cleat head 110 and the base 102, and one side of the first and second legs 120 and 122. In these embodiments, eight pins are used to secure the hinged coupling between the cleat head 110, the base 102, and the first and second legs 120 and 122.

When the cleat head 110 is rotated longitudinally with respect to the base 102 in the stowing rotation direction SR from the position shown in FIGS. 2A, 3A, 4, and 5 (deployed), the first pins 130 and 132 can rotate with respect to the cleat head 110 in a folding rotation direction FR1 toward the stowed position shown in FIGS. 2B and 3B (e.g., stay stationary with respect to the first and second legs 120 and 122). Similarly, the second pins 134 and 136 can rotate with respect to the base 102 in a folding rotation direction FR2 toward the stowed position shown in FIGS. 2B and 3B (e.g., stay stationary with respect to the first and second legs 120 and 122). In other embodiments, the pins 130, 132, 134, and 136 rotate with respect to the respective first and second legs 120 and 122, while staying stationary with respect to the base 102 and cleat head 110, or any combination thereof. When the cleat head 110 is rotated longitudinally with respect to the base 102 in a deploying rotation direction DR from the position shown in FIGS. 2B and 3B (stowed), the first pins 130 and 132 can rotate with respect to the cleat head 110 opposite the folding rotation direction FR1 toward the deployed position shown in FIGS. 2A, 3A, 4, and 5. Similarly, the second pins 134 and 136 can rotate with respect to the base 102 opposite the direction FR2 toward the deployed position shown in FIGS. 2A and 3A. In other embodiments, the pins 130, 132, 134, and 136 rotate with respect to the respective first and second legs 120 and 122 during deploying, while staying stationary with respect to the base 102 and cleat head 110, or any combination thereof.

The cleat 100 can include a detent feature to stop the rotation of the cleat head 110 in either the deploying rotation direction DR when the deployed position is reached, or the stowing rotation direction SR when the stowed position is reached. As shown in FIGS. 3A and 3B, the cleat 100 can include a detent spring member 119 positioned in an upper portion of the cleat head 110. In some embodiments, the detent spring member 119 is a flexible, resilient flat bar biased downward away from the cleat head 110 and configured to deflect in an upward direction toward the cleat head 110 in response to rotation of the cleat head 110 between the stowed and deployed positions. The detent spring member 110 can be made from spring steel, or any other resilient material that exhibits elasticity, such as composites, polyurethane, silicone rubber, or thermoplastics, that provides bias against the first and second legs 120 and 122. The detent spring member 119 is positioned to abut corresponding flat surfaces on the first and second legs 120 and 122. In this regard, the first leg can include a deployed flat portion 120*a* and a stowed flat portion 120*b*, and the second leg can include a deployed flat portion 122*a* and a stowed flat portion 122*b*. As shown in FIG. 3A, in the deployed position of the cleat head 110, the deployed flat portions 120*a* and 122*a* are generally aligned across the flat surfaces with the detent spring member 119, which is biased downward to retain the cleat head 110 in the deployed position by detent action of pressure applied to the deployed flat portions 120*a* and 122*a* by the detent spring member 119.

When stowing the cleat head 110 in the stowing rotation direction SR to the stowed position shown in FIG. 3B, the detent spring member 119 deflects upward based on the rotation of the first and second legs 120 and 122 and the peak area between the flat portions 120*a*, 120*b*, 122*a*, and 122*b*. As the cleat head 110 passes the midpoint of rotation and nears the stowed position, the downward bias of the detent spring member 119 interfaces with the stowed flat portions 120*b* and 122*b* and urges the cleat head 110 into the stowed position where the stowed flat portions 120*b* and 122*b* abut the detent spring member 119 across the flat surfaces.

Additionally, when stowing the cleat head 110 in the stowing rotation direction SR to the stowed position shown in FIGS. 2B and 3B, the head H of the fastener F nearer the first projection 112 can abut a stopping surface 121 (see FIG. 3B) on the first leg 120 configured to interface with the head H, and/or the head H of the fastener F nearer the second projection 114 can abut a standoff protrusion 118 shaped and configured to interface with the head H and retain the fastener F with respect to the base 102, as will be described in detail below. The interface between the detent spring member 119 and the stowed flat portions 120*b* and 122*b* are intended to provide a detent stop to the rotation of the cleat head 110 in the stowing rotation direction SR at the stowed position, while the interface between the detent spring member 119 and the deployed flat portions 120*a* and 122*a* are intended to provide a detent stop to the rotation of the cleat head 110 in the deploying rotation direction DR at the deployed position. In other embodiments, a portion of the cleat head 110 can contact the mounting surface to provide an interference stop to the rotation of the cleat head 110 in the stowing rotation direction SR at the stowed position, with the interface between the detent spring member 119 and the stowing flat portions 120*b* and 122*b* retaining the cleat head 110 in the stowed position.

In use, it can be desirable to releasably retain the cleat head 110 in either the stowed position or the deployed position until a user applies a minimum force to transition the cleat head 110 away from its current position. For example, when the cleat head 110 is not in use and is in the stowed position, movement of the watercraft could generally cause the cleat head 110 to vibrate or move, causing wear and noise. Similarly, if the cleat head 110 is in the deployed position, the cleat head 110 may rotate to the stowed position unintentionally. In the illustrated embodiments, the detent spring member 119 provides such retention. In other embodiments, any suitable feature to prevent unintentional movement, such as friction components (e.g., rubber), magnetic features, etc. are also within the scope of the present disclosure.

As shown in FIG. 2A, the cleat 100 can have a first fastener retention slot 140 and a second fastener retention slot 150 positioned on the base 102. The first and second fastener retention slots will be described in more detail below with respect to FIG. 6-7B. This arrangement is intended to conceal the fasteners when the cleat 100 is installed on the mounting surface and the cleat head 110 is in the stowed position. When the cleat head 110 is in the deployed position, only the rounded head H of the carriage bolt is visible, contributing to a clean and sleek appearance. In some embodiments, the first and second fastener retention slots 140 and 150 are configured to receive the fasteners F therein and prevent rotation of the fastener F such that a nut can be installed on the threaded shank end without using a tool to hold the fastener F head during installation. In the illustrated embodiments, the first and second fastener retention slots 140 and 150 are configured for use with the square portion S of a carriage-head fastener F; however, other fastener head types can be used.

Figure 6:
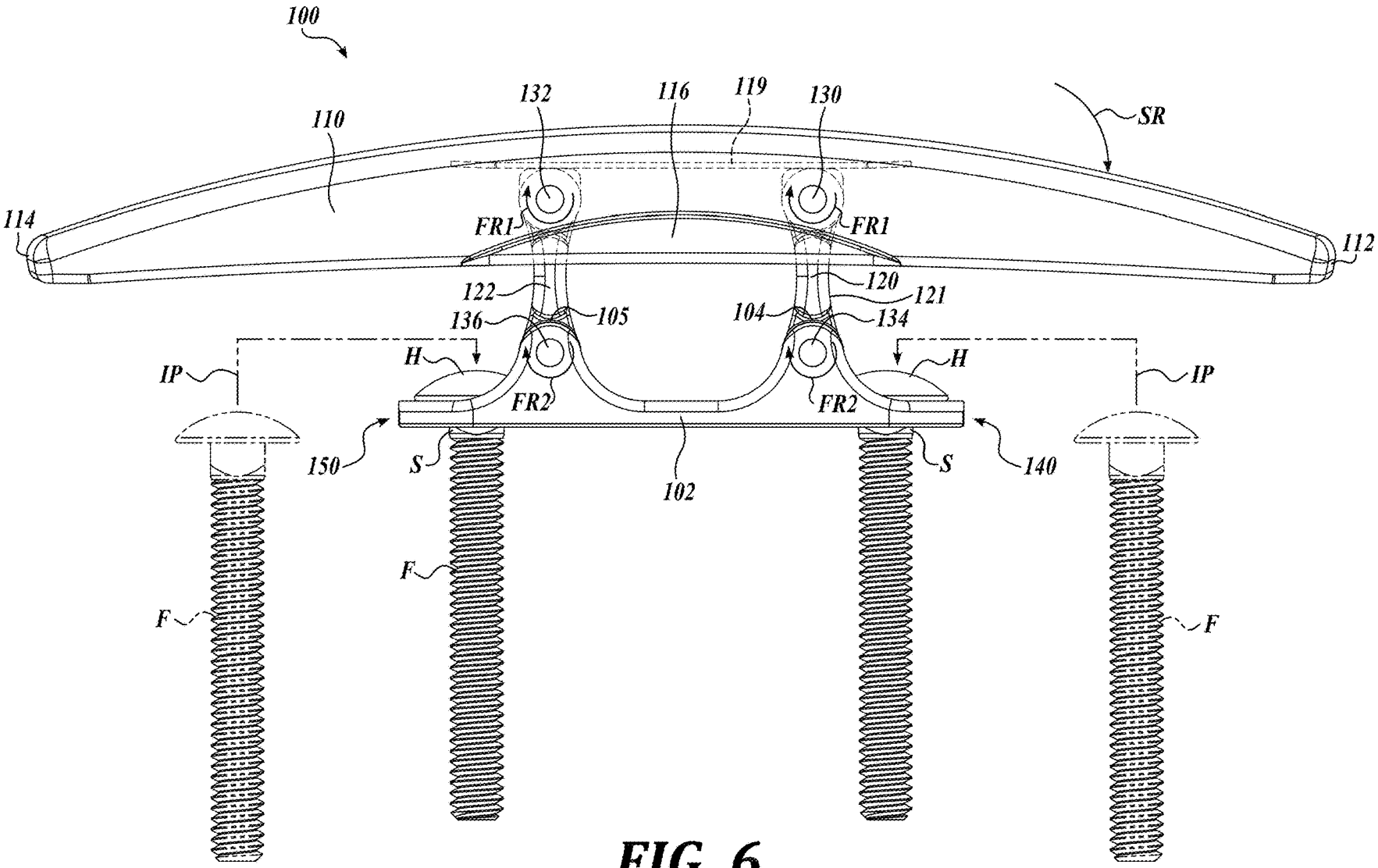
FIG. 6 is a side view of the folding marine cleat of FIG. 1, showing the installation path of fasteners in accordance with an embodiment of the present disclosure.

FIG. 6 is a side view of the cleat 100, showing installation paths IP of each of the fasteners F in accordance with an embodiment of the present disclosure. With the cleat 100 in the deployed position, but uninstalled on the mounting surface, the fasteners F can be installed into the first and second fastener retention slots 140 and 150 (hereinafter "slots 140 and 150") of the base 102 along the installation path IP. In this regard, the features of the slots 140 and 150 (which will be explained in detail below with reference to FIGS. 7A and 7B), do not permit the head H or square portion S of the fastener F to slide laterally into the slots 140 and 150. Instead, the head H and square portion S of each fastener F must first be positioned above the slots 140 and 150, and then can be lowered into the slots 140 and 150 such that the square portions S are received into the slots 140 and 150 to secure the fasteners therein. With the fasteners F installed into the slots 140 and 150, the shank of the fastener is generally aligned perpendicular to a bottom surface of the base 102 and can be inserted into respective holes in the mounting surface to fixedly mount the cleat 100 to the mounting surface, e.g., on a watercraft, dock, or other structure.

The square portion S of the fastener F requires rotational alignment (see, e.g., FIG. 7A) prior to inserting the square portion S into the slots 140 and 150. The aligned orientation of the fastener F permits seating of the fastener F into slots 140 and 150 to prevent rotation of the fastener, as will be described with reference to FIGS. 7A and 7B. As shown, the seating of the fasteners F in the slots 140 and 150 prevents the cleat 100 from moving longitudinally in either direction. These fastener retention slot features will now be explained in further detail with reference to FIGS. 7A and 7B. Although the following description references a fastener interfacing with the second fastener retention slot 150, a similar configuration is intended for the first fastener retention slot 140.

Figure 7A:
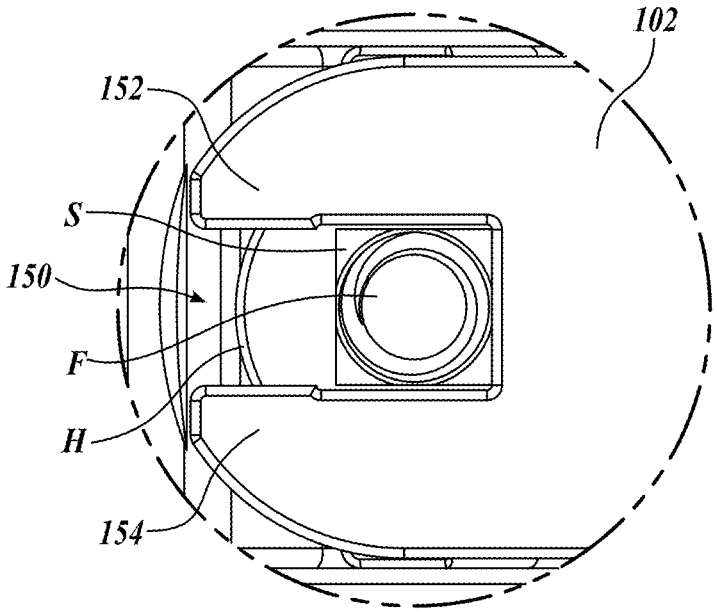
FIG. 7A is a detail view of the folding marine cleat of FIG. 5, shown with the fastener.
Figure 7B:
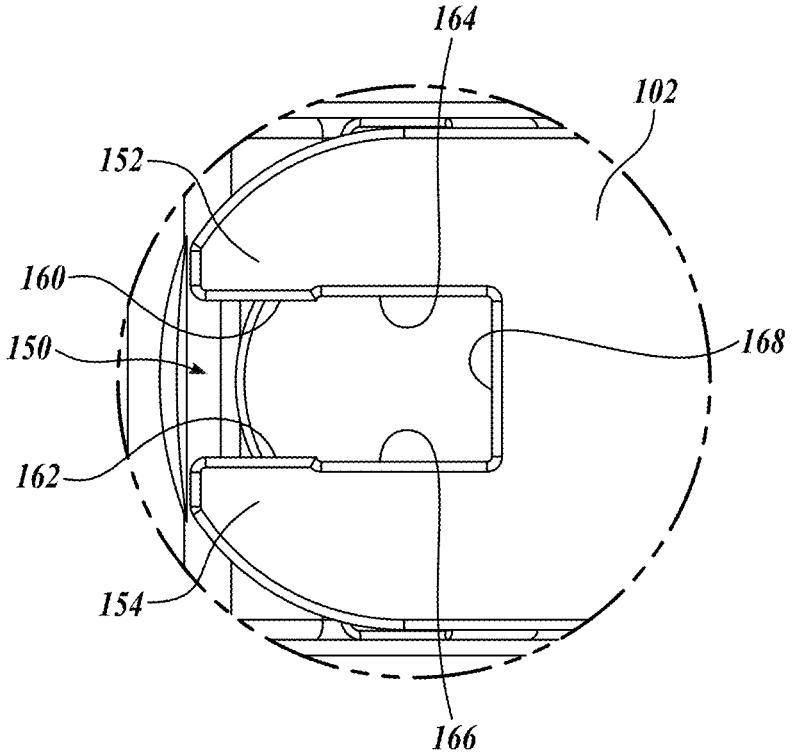
FIG. 7B is a detail view of the folding marine cleat of FIG. 5, shown without the fastener.

FIGS. 7A and 7B are detail views of the cleat 100, shown with the fastener F (FIG. 7A) and without the fastener F (FIG. 7B) for purposes of clarity, each in accordance with embodiments of the present disclosure. As shown in FIG. 7A, the base 102 includes a first jaw 152 and a second jaw 154, together forming an open slot portion of the second fastener retention slot 150. The first and second jaws 152 and 154 can be sized and configured to support the head H of the fastener F when seated, while closely surrounding the square portion S to prevent rotation of the fastener F (e.g., to permit installation of the cleat 100 without using a tool to hold the head H of the fastener F).

As shown in FIG. 7B, the first and second jaws 152 and 154 form the second fastener retention slot 150, with an opposing opening surfaces 160 and 162, opposing retention surfaces 164 and 166, and an end retention surface 168. The width of the opposing opening surfaces 160 and 162 can be smaller than the distance across the flats of the square portion S of the fastener F, but equal to or greater than the diameter of the threads on the shank portion of the fastener F. In this regard, the shank portion of the fastener F can pass through the opposing opening surfaces 160 and 162, but the square portion S is too wide to slide laterally in or out of the second fastener retention slot 150, and a vertical path (see installation path IP in FIG. 6) is required to insert the square portion S of the fastener F into the second fastener retention slot 150. The width of the opposing retention surfaces 164 and 166 can be equal to or greater than the distance across the flats of the square portion S of the fastener F. In this regard, the opposing retention surfaces 164 and 166 are spaced wider than the opposing opening surfaces 160 and 162, which prevents lateral movement of the fastener F once seated in the slot 150. The end retention surface 168 is configured to interface with the flat of the square portion S that is positioned between the flats that interface with the opposing retention surfaces 164 and 166, while the steps at the transition between the surfaces 160 and 164 and the surfaces 162 and 166 interface with corners of the square portion S opposite the end retention surface 168. In this regard, when the fastener F is seated in a retention slot (the slots 140 and 150), the fastener is fixed in all degrees of freedom except vertical translation upward out of the retention slot when the cleat 100 is in the deployed position (as described above, the standoff protrusion 118 and the stopping surface 121 are configured to fix the fasteners F in the upward direction of vertical translation). Although the surfaces 160, 162, 164, 166, and 168 are shown as generally planar surfaces, in other embodiments, the surfaces can be curved or have multiple planar surfaces while retaining the fastener F therein. In this regard, the surfaces 164, 166, and 168 may not closely abut three of the four flats of the square portion S in the seated position of the fastener F. In further embodiments, the internal surface configuration of the retention slots can be adapted to correspond to any shape of bolt feature (e.g., triangular, hexagonal, etc.).

The marine cleats described herein can be formed from any suitable material, such as stainless steel, which provides corrosion protection in marine environments; however, other material configurations are also within the scope of the present disclosure.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 10% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The invention claimed is:

1. A folding marine cleat for securing a line to a structure, the folding marine cleat comprising:

a cleat base configured to operably couple to a mounting surface of the structure;

a cleat head having a first projection and a second projection extending in opposite directions along the mounting surface, the cleat head being configured to receive a portion of the line;

a detent spring member extending along the cleat head from the first projection to the second projection and having a downward bias away from the cleat head; and first and second legs each hingedly coupled to the cleat base and the cleat head, the first and second legs each having a deployed flat portion and a stowed flat portion positionable to selectively be in contact with and abutting the detent spring member, wherein the cleat base, the cleat head, the first leg, and the second leg together form a four-bar linkage to transition the cleat head between a stowed position and a deployed position relative to the cleat base, wherein, in the deployed position, the deployed flat portions of the first and second legs are in surface contact with the detent spring member, which is biased against the deployed flat portions to retain the cleat head in the deployed position, and wherein, in the stowed position, the stowed flat portions of the first and second legs are in surface contact with the detent spring member, which is biased against the stowed flat portions to retain the cleat head in the stowed position.

2. The folding marine cleat of claim 1, wherein the detent spring member is a resilient flat bar configured to deflect upward toward the cleat head during transition of the cleat head between the stowed and deployed positions.

3. The folding marine cleat of claim 1, wherein the detent spring member is manufactured from spring steel, composite, polyurethane, silicone rubber, or thermoplastics.

4. The folding marine cleat of claim 1, wherein the cleat base further comprises a first fastener retention slot and a second fastener retention slot, wherein the first and second fastener retention slots each include a first jaw and a second jaw extending from the cleat base and together defining an open slot portion with opposing opening surfaces and opposing retention surfaces, the opposing retention surfaces being spaced apart at a distance configured to receive a square portion of a fastener therebetween to fix the fastener in axial rotation with respect to the cleat base, and the opposing opening surfaces being spaced apart at a distance narrower than a distance across the square portion of the fastener.

5. The folding marine cleat of claim 4, wherein the open slot portions of the first and second fastener retention slots open in opposite directions from each other.

6. The folding marine cleat of claim 4, wherein first and second fastener retention slots each further comprise an end retention surface adjacent to the opposing retention surfaces, wherein the end retention surface is configured to interface with the square portion of the fastener to prevent lateral translation of the fastener along the opposing retention surfaces.

7. The folding marine cleat of claim 4, wherein the opposing opening surfaces are spaced apart at a distance configured to permit a shank portion of the fastener to laterally pass through the opposing opening surfaces toward the opposing retention surfaces.

8. The folding marine cleat of claim 1, wherein the cleat base further comprises a first upward peak and a second upward peak, wherein the first leg is hingedly coupled to the first upward peak by a first pin, and wherein the second leg is hingedly coupled to the second upward peak by a second pin.

9. The folding marine cleat of claim 8, wherein the first leg is hingedly coupled to the cleat head by a third pin, and wherein the second leg is hingedly coupled to the cleat head by a fourth pin.

10. The folding marine cleat of claim 1, wherein the cleat head is longitudinally foldable by rotating the first and second legs with respect to the cleat base.

11. The folding marine cleat of claim 1, wherein the cleat head further comprises a standoff protrusion positioned and configured to interface with a head of the fastener when the cleat head is in the stowed position, wherein the interface of the standoff protrusion and the head of the fastener fixes the fastener in an axial translation direction with respect to the cleat base.

12. The folding marine cleat of claim 1, wherein the cleat head further comprises an opening relief configured to receive a finger of a user to assist in transitioning the cleat head from the stowed position to the deployed position.

13. A longitudinally folding marine cleat for securing a line to a watercraft, the folding marine cleat comprising:

a cleat base configured to operably couple to a mounting surface of the structure, the cleat base having a first fastener retention slot having an open slot portion with opposing opening surfaces and opposing retention surfaces, the opposing retention surfaces being spaced apart at a distance configured to receive a square portion of a fastener therebetween to fix the fastener in axial rotation with respect to the cleat base, and the opposing opening surfaces being spaced apart at a distance narrower than a distance across the square portion of the fastener;

an elongate cleat head having a detent spring member extending along a longitudinal length of the cleat head and having a downward bias away from the cleat head, the cleat head configured to receive a portion of the line; and first and second legs each hingedly coupled to the cleat base and the cleat head, the first and second legs each having a deployed flat portion and a stowed flat portion positionable to selectively be in contact with and abutting the detent spring member, wherein the cleat base, the elongate cleat head, the first leg, and the second leg together form a four-bar linkage to transition the elongate cleat head between a stowed position and a deployed position relative to the cleat base.

14. The longitudinally folding marine cleat of claim 13, wherein, in the deployed position, the deployed flat portions of the first and second legs are in surface contact with the detent spring member, which is biased against the deployed flat portions to retain the cleat head in the deployed position, and wherein, in the stowed position, the stowed flat portions of the first and second legs are in surface contact with the detent spring member, which is biased against the stowed flat portions to retain the cleat head in the stowed position.

15. The longitudinally folding marine cleat of claim 13, wherein the detent spring member is a resilient flat bar configured to deflect upward toward the cleat head during transition of the cleat head between the stowed and deployed positions.

16. The longitudinally folding marine cleat of claim 13, wherein the detent spring member is manufactured from spring steel, composite, polyurethane, silicone rubber, or thermoplastics.

17. The longitudinally folding marine cleat of claim 13, further comprising a second fastener retention slot having an open slot portion open in an opposite direction from the first fastener retention slot, wherein the second fastener retention slot comprises opposing opening surfaces and opposing retention surfaces, the opposing retention surfaces being spaced apart at a distance configured to receive the square portion of the fastener therebetween to fix the fastener in axial rotation with respect to the cleat base, and the opposing opening surfaces being spaced apart at a distance narrower than a distance across the square portion of the fastener.

18. The longitudinally folding marine cleat of claim 17, wherein first and second fastener retention slots each further comprise an end retention surface adjacent to the respective opposing retention surfaces, wherein the end retention surface is configured to interface with the square portion of the fastener to prevent lateral translation of the fastener along the respective opposing retention surfaces.

19. The longitudinally folding marine cleat of claim 13, wherein:

the cleat base further comprises a first upward peak and a second upward peak, wherein the first leg is hingedly coupled to the first upward peak by a first pin and the second leg is hingedly coupled to the second upward peak by a second pin; and the cleat head further comprises a first downward peak and a second downward peak, wherein the first leg is hingedly coupled to the first downward peak by a third pin and the second leg is hingedly coupled to the second downward peak by a fourth pin.

20. The longitudinally folding marine cleat of claim 13, wherein the cleat head further comprises a standoff protrusion positioned and configured to interface with a head of the fastener when the cleat head is in the stowed position, wherein the interface of the standoff protrusion and the head of the fastener fixes the fastener in an axial translation direction with respect to the cleat base.

* * * * *